US007121712B1

(12) United States Patent
Lin

(10) Patent No.: US 7,121,712 B1
(45) Date of Patent: Oct. 17, 2006

(54) STEPWISE COMBINED SOCKETS FOR CHRISTMAS LIGHTS

(76) Inventor: Mei-Lu Lin, P.O. Box 697, Fongyuan City, Taichung County (TW) 420

( * ) Notice: Subject to any disclaimer, the term of this patent is extended or adjusted under 35 U.S.C. 154(b) by 71 days.

(21) Appl. No.: 11/094,141

(22) Filed: Mar. 31, 2005

(51) Int. Cl.
*H01R 33/00* (2006.01)

(52) U.S. Cl. ..... 362/654; 362/252; 362/249; 362/653; 362/655; 439/699.2

(58) Field of Classification Search ..... 362/652–654, 362/227, 238, 249, 252; 439/699.2
See application file for complete search history.

(56) References Cited

U.S. PATENT DOCUMENTS 5,938,314 A * 8/1999 Lin ..... 362/249
7,001,062 B1 * 2/2006 Lin ..... 362/654
7,066,625 B1 * 6/2006 Lin ..... 362/252

* cited by examiner

*Primary Examiner*—Stephen F Husar
*Assistant Examiner*—James W Cranson, Jr.

(57) ABSTRACT

A stepwise combined sockets for Christmas lights includes a pair of first and second sockets stepwise combined together with the first socket higher the second socket, a vertical space form between the pair of socket slightly extended into second socket, a first inlaid groove in an inner periphery of the second socket and pair of second inlaid groove respectively formed in an inner periphery of the sockets opposite to the vertical space for engaging a pair of single contact plates from a first and a second electric wires, a bent common contact plate striding over the two socket having an upper vertical portion disposed into the first socket a transverse portion stopping on the bottom of the vertical space and a lower vertical portion engaged within the first inlaid groove in the second socket, a wrapper ring wrapped the upper rim of the first socket having a downward projection from a side thereof blocking the vertical space, the projection having a lower end stopped against the transverse portion of the common contact plate and a third inlaid groove in an inner side to engaged with the upper vertical portion of the common contact plate, and a pair of lamps respectively inserted into the upper rim of the socket each including a base, a bulb on the base and pair of lead-in wires attached to the outer lateral sides of the base respectively engaged with the common contact plate and the single contact plates.

5 Claims, 9 Drawing Sheets

STEPWISE COMBINED SOCKETS FOR CHRISTMAS LIGHTS

BACKGROUND OF THE INVENTION

The present invention relates to Christmas lights and more particularly to a stepwise combined sockets for Christmas lights which effectively uses a common contact plate and tightly fix the lamps in the sockets that is featured in the readily assembly and good electric conductivity without structurally breakaway.

Normally, the Christmas lights is a string of plurality of lamps which is used to suspend from a Christmas tree or suitable objects to enjoy people in the Christmas eve. However, this type of Christmas lights becomes more and more out of fashion. So that the producers begin to manufacture a gang type sockets which is integrated a number of the socket together to shorten the distance between the lamps for brightening the Christmas light to delight people. Nevertheless, the combined sockets leave a small space that is usually difficult to assembly the component such as a common contact plate and the electric wires, causing a poor conductivity and a breakaway of the components. This is the reason that structure of combined socket is still unpopular in the market.

SUMMARY OF THE PRESENT INVENTION

The present invention has a main object to provide a stepwise combined sockets for Christmas lights, which is able to positioning the common contact plate, tightly fix the lamps within the sockets. The assembly is readily to present good conductivity of electricity and the components is not breakaway.

Another object of the present invention is to provide a stepwise combined sockets for Christmas lights which is stepwise combined a number of sockets together that provides more remarkable outlook than the conventional string of Christmas lights.

Accordingly, the stepwise combined sockets for Christmas lights of the present invention comprises at least a pair of socket combined stepwise on their outer peripheries, a vertical space formed therebetween, wherein, the first and second sockets each has a first inlaid groove in their connected portion.

At least a pair of lamps each has a base with a bulb in the top respectively inlaid into the sockets having their lead-in wires attached to the outer lateral sides of the base and inlaid into the socket in concert with the bases.

A wrapper ring has a downward rectangular projection. In the inner side of which is also a inlaid groove.

A pair of electric wires each has a contact plate on the top inserted into a pair of second inlaid grooves.

A bent common contact plate having upper portion inserted into the inlaid groove of the downward rectangular projection and a lower portion striding over the vertical space and positioned into a first inlaid grove of the second socket. When the common contact plate is positioned within the two sockets, the wrapper ring is wrapped on the first socket to fix the common contact plate as will as the lamps to accomplished a pair of stepwise combined sockets.

The present invention will become more fully understood by reference to the following detailed description thereof when read in conjunction with the attached drawings.

DETAILED DESCRIPTION OF THE PREFERRED EMBODIMENT

Figure 1:
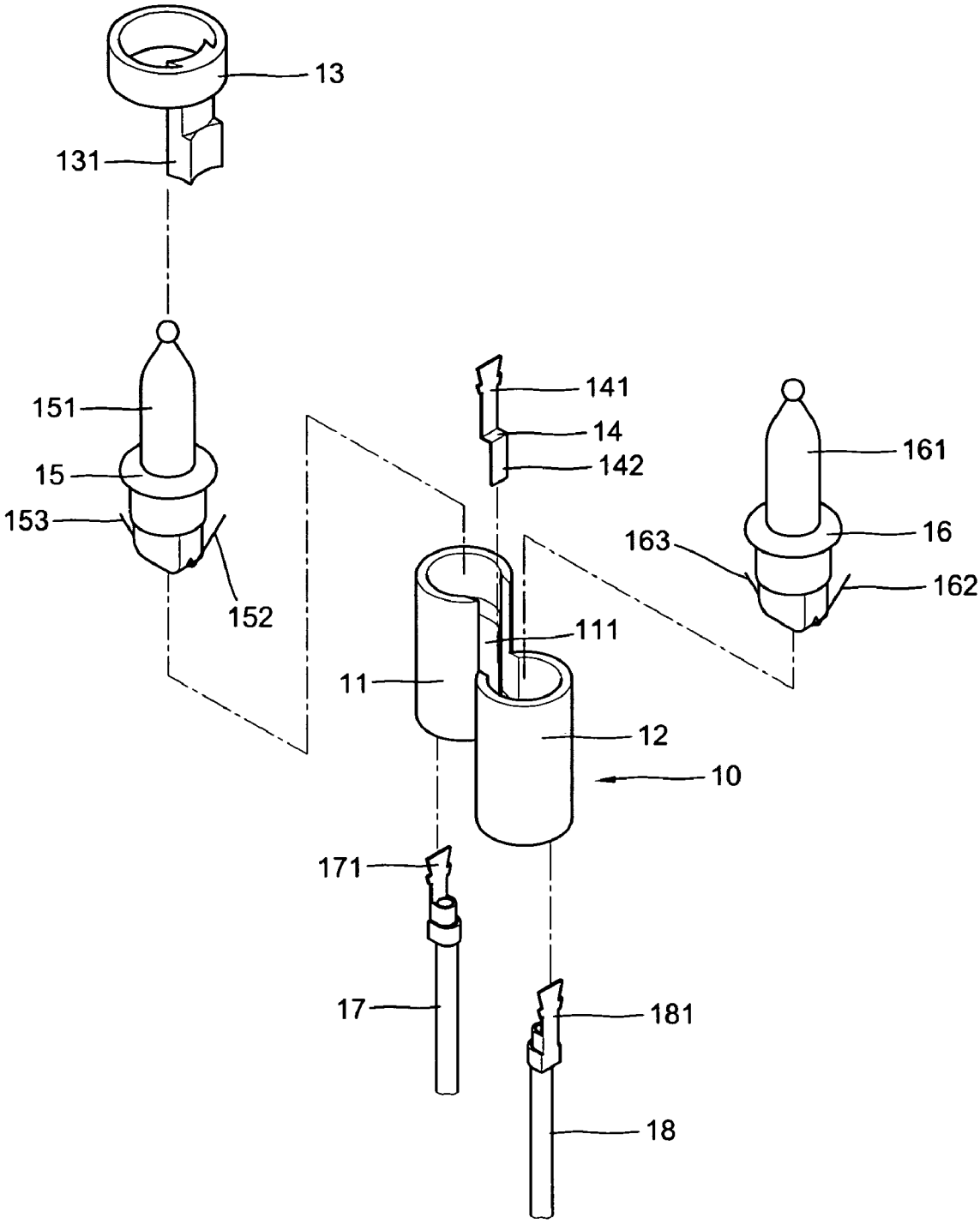
FIG. 1 is an exploded perspective view to show the first embodiment of the stepwise combined sockets of the present invention.
Figure 2:
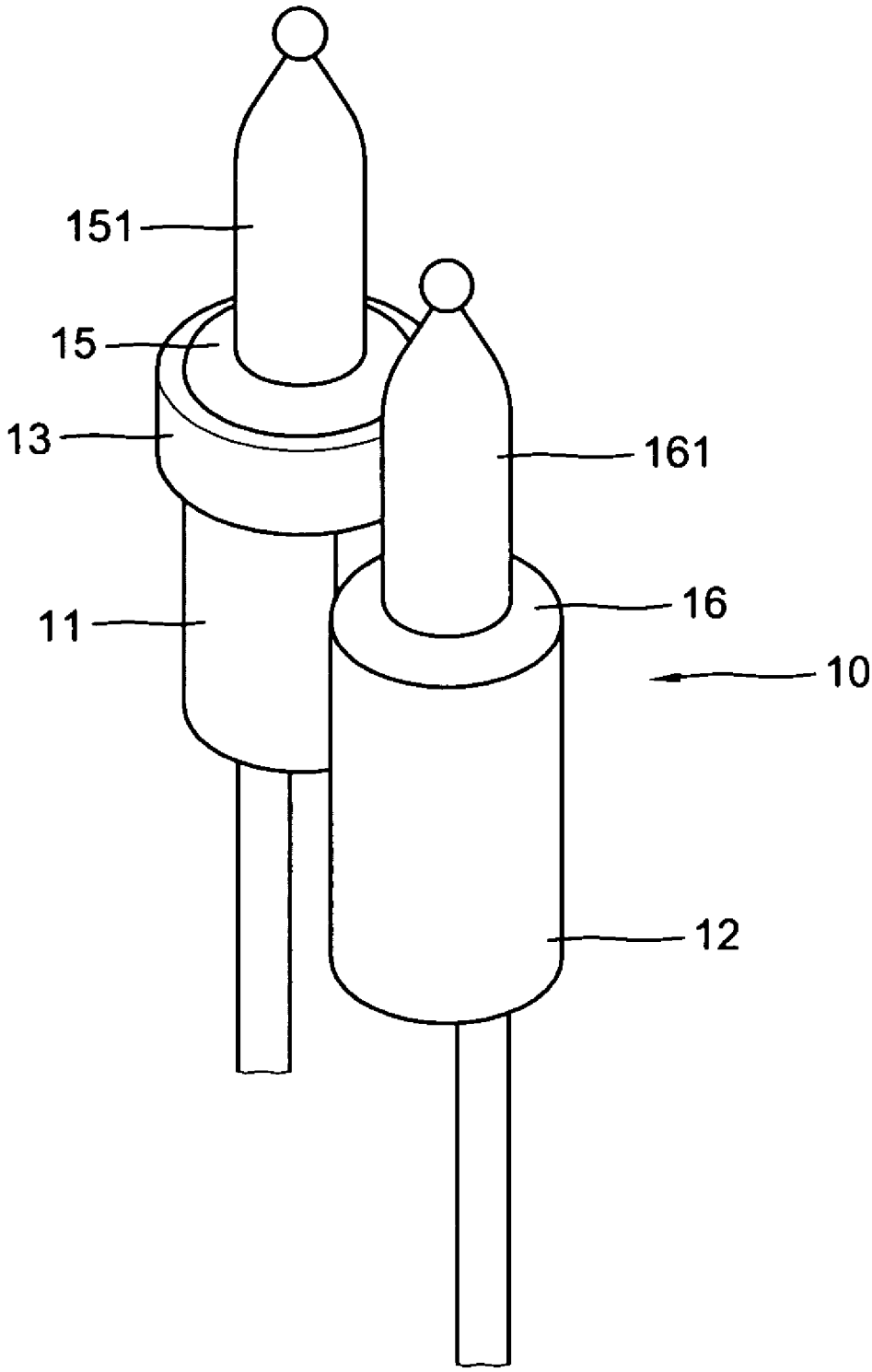
FIG. 2 is a perspective view to show the assembly of FIG. 1.
Figure 3:
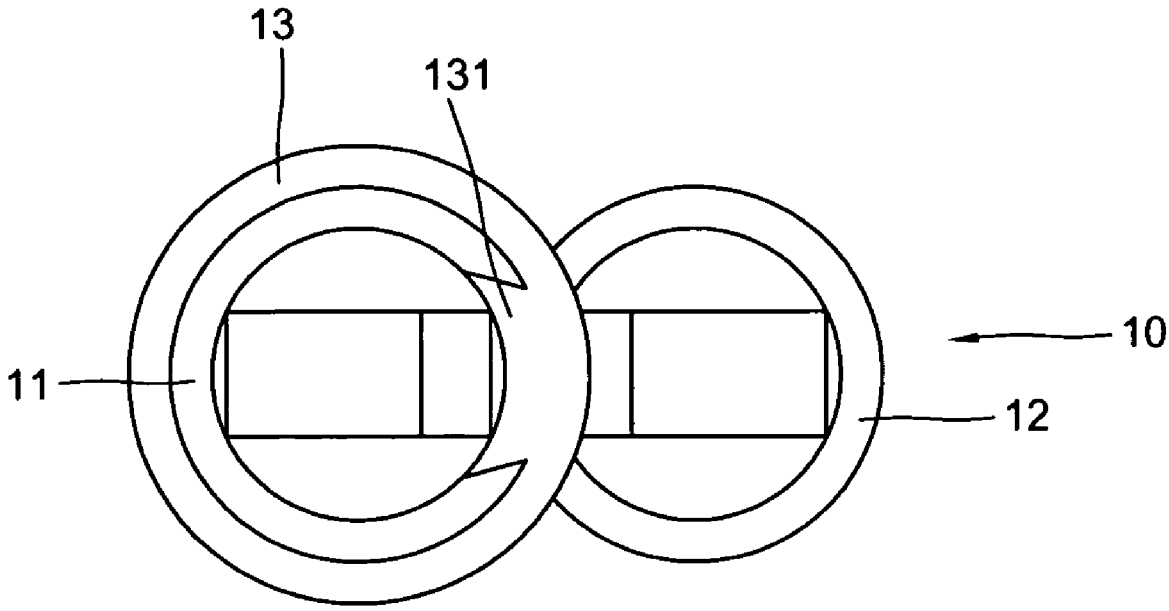
FIG. 3 is a top plane view to show the engagement of the wrapper ring onto the first socket with a downward projection locking a vertical space.
Figure 4:
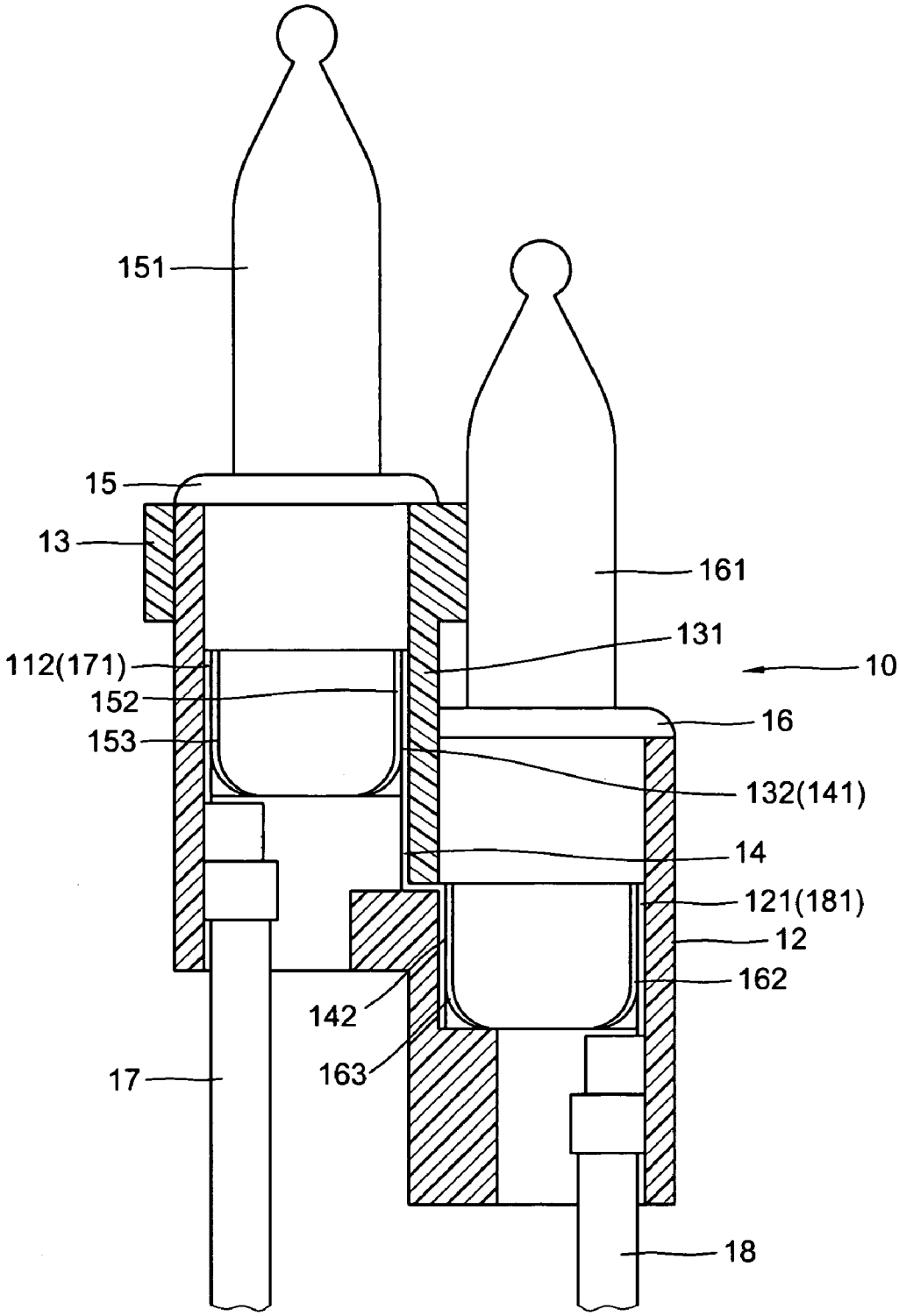
FIG. 4 is a sectional view of FIG. 2.
Figure 5:
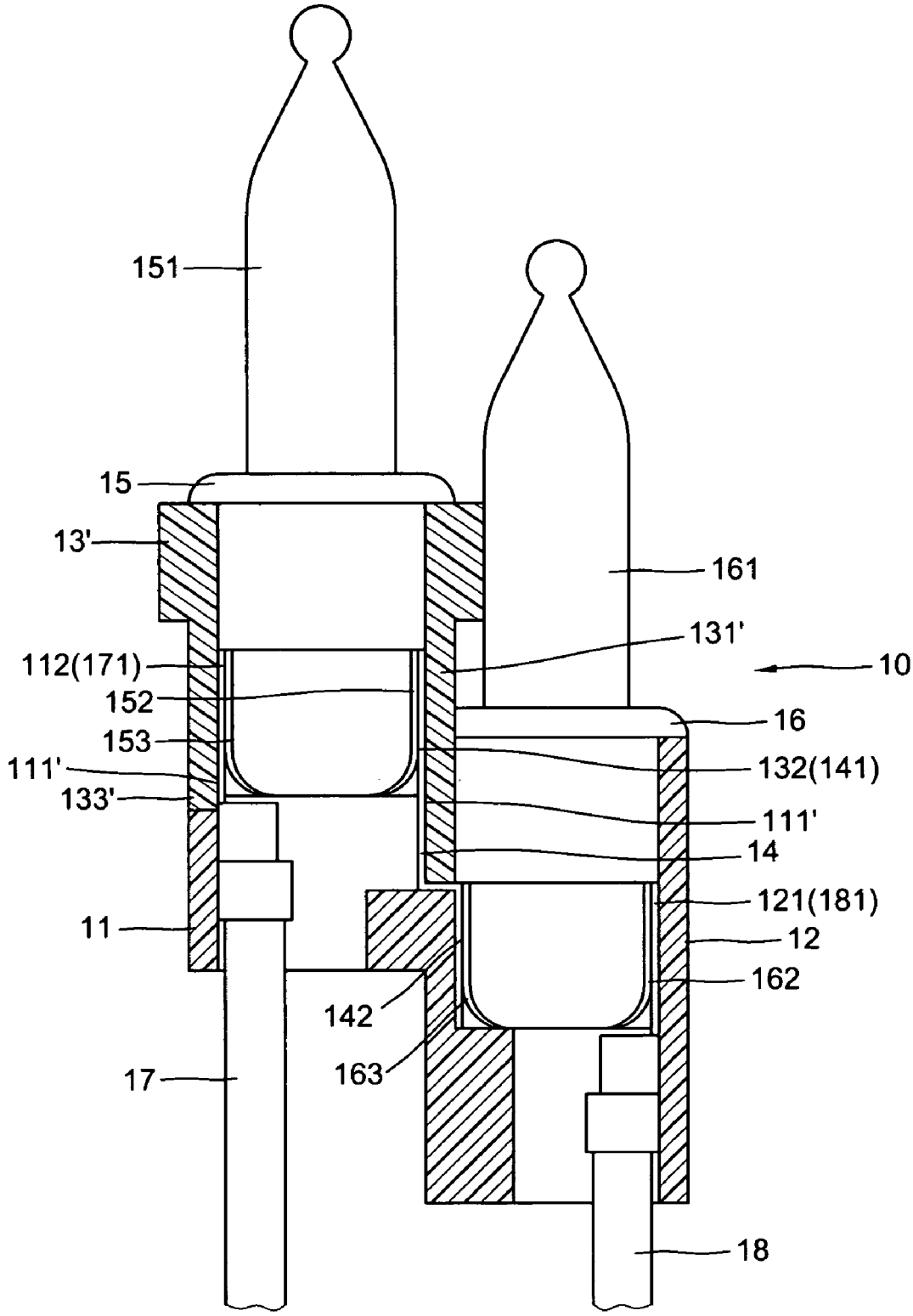
FIG. 5 is a sectional view to show that wrapper ring has a pair of downward projections.
Figure 6:
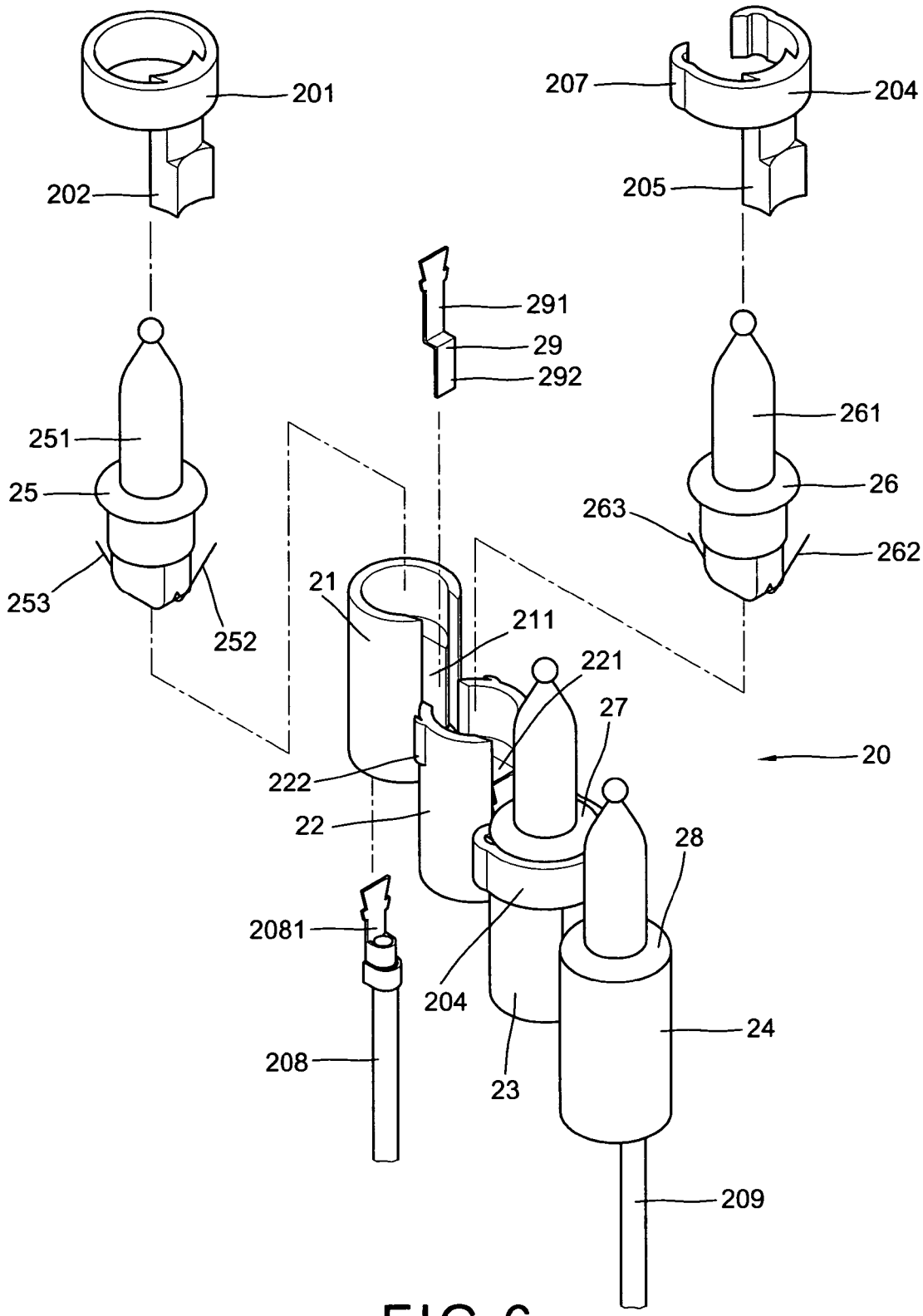
FIG. 6 is an exploded perspective view to show a second embodiment of the stepwise combined sockets of the present invention.
Figure 7:
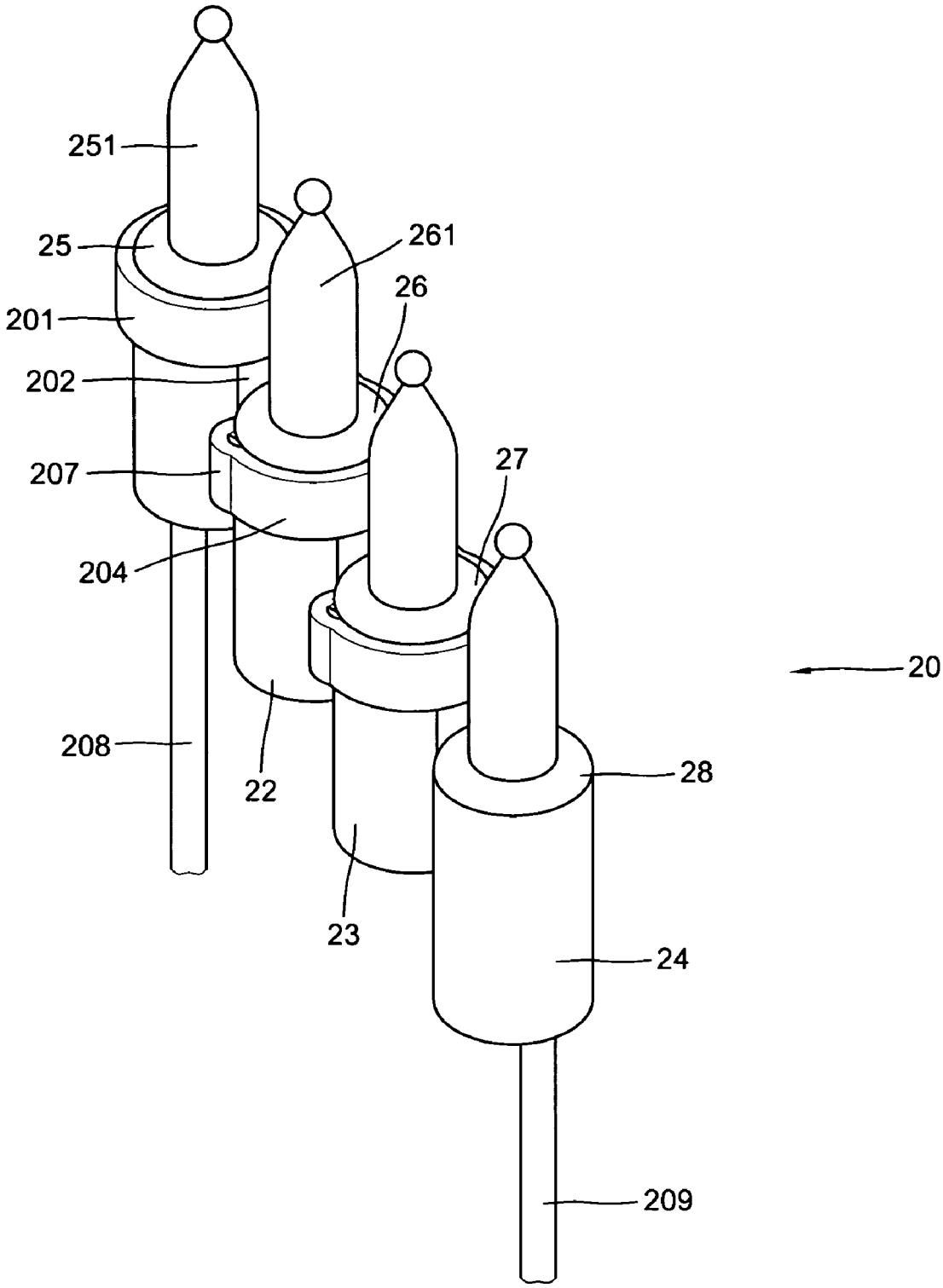
FIG. 7 is a perspective view to show the assembly of FIG. 6.
Figure 8:
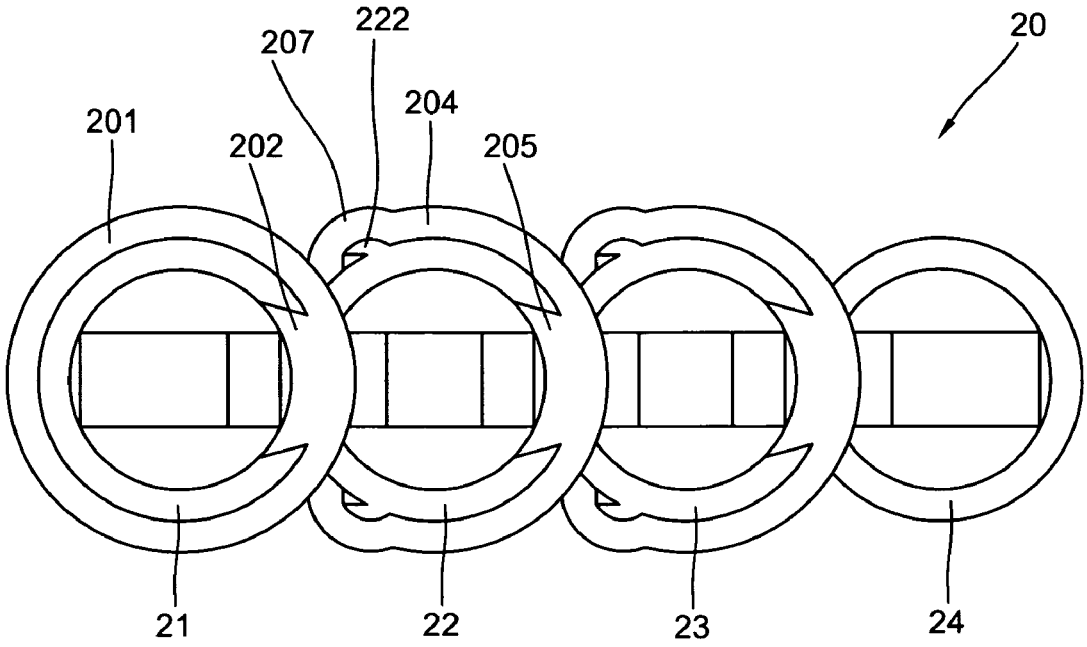
FIG. 8 is a top plane view to show the wrapper ring and the fastening rings on the sockets.
Figure 9:
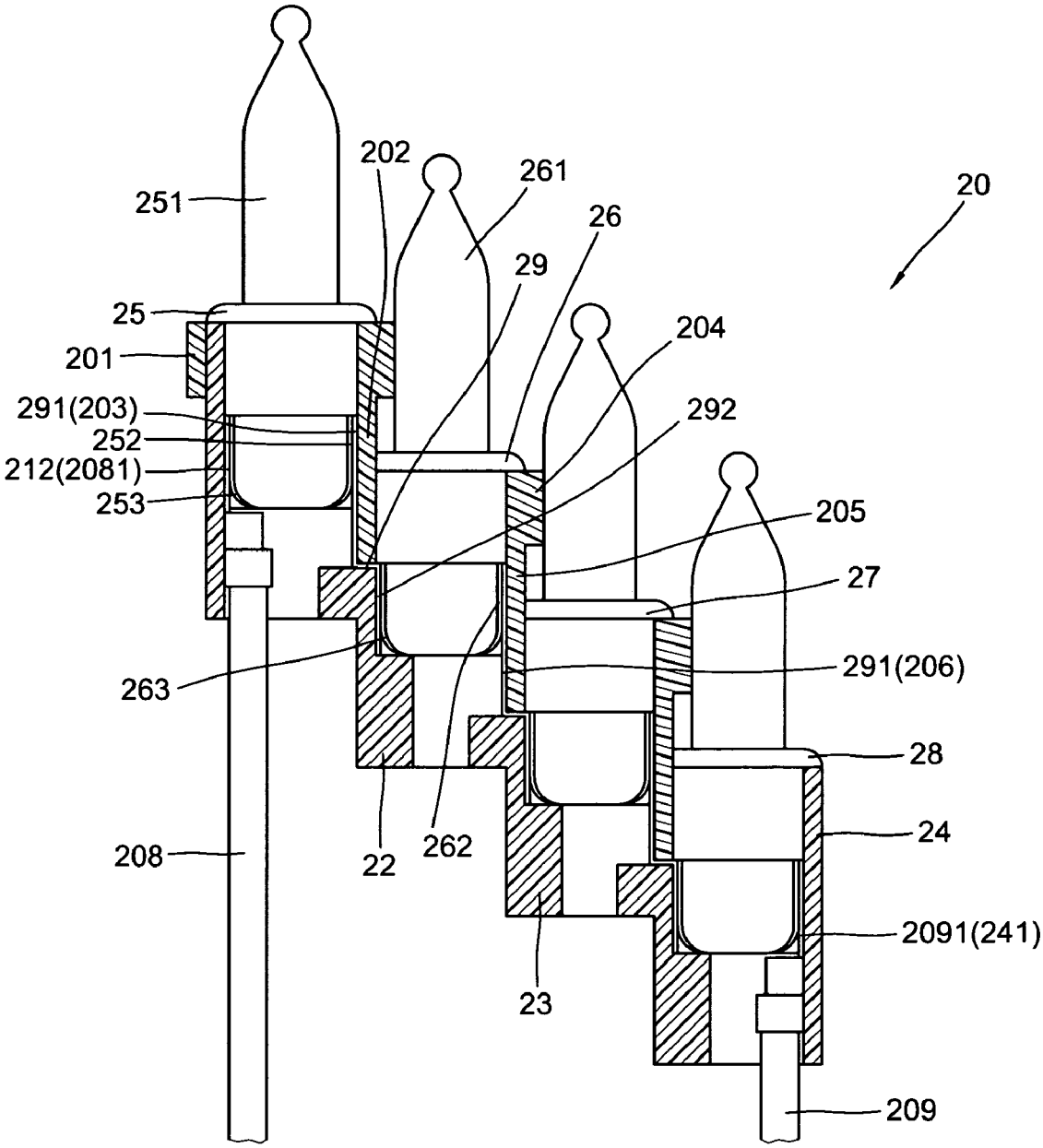
FIG. 9 is a sectional view of FIG. 7.

With reference to FIGS. 1 to 4 of the drawings, the first embodiment of the stepwise combined sockets 10 of the present invention comprises a pair of the first and second sockets 11 and 12 unevenly combined together on their outer peripheries with the first socket 11 positioned higher than the second socket 12, a vertical space 111 formed in the connection portion for disposing a bent common plate 14 which strides over the bottom of the space 111 so having an upper portion 141 in the first socket 11 and a lower portion in the second socket 12, a wrapper ring wrapped on the upper rim of the first socket 11 including a downward rectangular projection 131 closed the space 111 and stopped against the transverse portion of the common contact plate 14 and having a first inlaid groove to receive the upper portion 141 of the common contact plate 14, and a pair of second inlaid grooves 112 and 121 on the inner periphery of each of the socket 11 and 12, opposite to the vertical space 111, a pair of lamps 15 and 16 each having a bulb 151 and 161 in the top of the base and a pair of lead-in wires 152 and 153, 162 and 163 respectively attached on the outer lateral sides of the base which are respectively inserted into the upper rim of the first and second sockets 11 and 12, a pair of electric wires 17 and 18 each having a single contact plate 171 and 181 engaged within the second inlaid grooves 112 and 121. The lead-in wires 152 and 153 respectively engage with the upper portion 141 of the common contact plate 14 and the single contact plate 171, whereas the lead-in wires 162 and 163 respectively engage with the single contact plate 181 and the lower portion 142 of the common contact plate 14. FIG. 5 show that if the socket 11 has two vertical spaces 111' on opposing peripheries, a wrapper ring 13' may has two downward rectangular projections 131' and 133' to respectively block the vertical spaces 111'.

Referring to FIGS. 6 to 9 of the drawings, a second embodiment of the stepwise combined sockets 20 is provided which may have a first, a second, a third and a fourth sockets 21, 22, 23 and 24 or more. The four lamps 25, 26, 27 and 28 can be more either. The first socket 21 has a vertical space 211 between the second socket 22 and a first inlaid groove 212 in an inner periphery opposite to the vertical space 211 for engaging within a single contact plate 2081 from a first electric wire 208. The fourth socket 24 has also second inlaid groove 241 in an inner periphery for engaging within a single contact plate 2091 from a second electric wire 209. A plurality of bent common contact plates 29 are stridden over the vertical spaces 211, 221 and the vertical space between the third and the fourth socket 23 and 24 having their upper portions 291 inserted into the upper portions of the first and third socket 21 and 23 and their lower portions 292 into the upper portion of the second and the fourth sockets 22 and 24. The second and the third socket 22 and 23 each has a pair of vertical protrusions 222 on upper outer peripheries adjacent the vertical space 211 and 221. A wrapper ring 204 and a pair C-shaped fastening rings 204 respectively wrapped on the upper of rim of the first, second and third sockets 21, 22 and 23 each having downward rectangular projection 202 and 205 blocked the vertical spaces 211 and 221 and so on and stopped against the transverse portion of the common contact plates 29, wherein the projections 202 and 205 each has an inlaid groove in inner side (not shown) for engaging the upper portion 291 of the common contact plates 29 and the C-shaped fastening rings each has a pair of hooked ends engaged with the vertical protrusions 222 of the second and third sockets 22 and 23. Four lamps 25, 26, 27 and 28 respectively inserted into the upper rim of the sockets 21, 22, 23 and 24 and each has a base, a bulb in the top of the base and a pair of lead-in wires attached to the outer lateral sides of the base respectively engaged with a common contact plate but the outer lead-in wire of the first and fourth lamps respectively engaged with the single contact plates 2081 and 2091. So that an electric current circulation is established within the four sockets 21, 22, 23 and 24. Based on the above discussed structure, the number of socket may be unlimited and the stepwise combined sockets of the resent invention is readily to assembly and has minor breakdown.

Note that the specification relating to the above embodiments should be construed as an exemplary rather than as a limitative of the present invention, with many variations and modifications being readily attainable by a person of average skill in the art without departing from the spirit or scope thereof as defined by the appended claims and their legal equivalents.

I claim:

1. A stepwise combined sockets for Christmas lights comprising:

a pair of stepwise combined first and second sockets with the first socket positioned higher than second socket and having a vertical space formed along the connecting periphery through the upper rims of said sockets, a first inlaid groove formed in an inner periphery opposite to said vertical space for engaging with a single contact plate on top of a first electric wire, wherein said second socket has a second inlaid groove formed in an inner periphery opposite to said vertical space either, for engaging with a single contact plate on top of a second electric wire, a bent common contact plate striding bottom of said vertical space having an upper vertical portion disposed into said first socket, a transverse portion on the bottom of said vertical space and a lower vertical portion disposed into said second socket and engaged within a third inlaid groove in an inner periphery under said vertical space;

a wrapper ring wrapped on the upper rim of said first socket having a downward projection on a side enabling to close said vertical space and a fourth inlaid groove in an inner side of said projection for engaging with the upper vertical portion of said common contact plate;

a pair of lamps each having a base, a bulb in top of the base and a pair of lead-in wires attached on lateral sides of the base respectively engaged with a single contact plate and said bent common contact plate;

whereby, an electric current circulation is therefore established inside said sockets to lighten said lamps.

2. The stepwise combined sockets as recited in claim 1, wherein said projection has a lower end stopped against the transverse portion of said bent common contact plate.

3. The stepwise combined sockets as recited in claim 1, said projection may be doubled where said first socket has two vertical spaces in opposing peripheries.

4. A stepwise combined sockets for Christmas lights comprising:

a first, second, third and fourth sockets stepwise combined together each having an upper rim and an open bottom wherein the first, second and third socket each having a vertical space formed from their upper rims slightly through the upper rims of the adjacent sockets, a first and a second inlaid grooves formed in an inner periphery of said first and fourth sockets opposite to their vertical spaces for respectively engaging with a pair of single contact plates from a first and a second electric wires;

at least a bent common contact plates respectively striding over the vertical spaces between adjacent sockets each having an upper vertical portion disposed into the odd number sockets' a lower vertical portion disposed into the even number sockets, where has a third inlaid groove in an inner periphery under said vertical spaces for engaging with the lower vertical portions of said bent common contact plates;

a wrapper ring wrapped to the upper rim of the first socket having a downward projection blocking the vertical space between first and second socket and having a lower end stopped against the transverse portion of said bent common contact plate, and a fourth inlaid groove in inner side to receive the upper vertical portion of said common contact plate;

a pair of C-shaped fastening rings respectively sleeved on the upper rim of said second and third sockets each having a pair hooked end engaged with a pair vertical protrusions on opposing outer periphery of the second a third sockets, a downward projection blocking the vertical spaces of the second and third sockets and a fifth inlaid groove in inner side for receiving the upper vertical portion of their common contact plates;

a plurality of lamps respectively inserted into the upper rim of each socket and each having a base, a bulb in top of the base and a pair of lead-in wires attached to outer lateral sides of the base, wherein the lead-in wires in the first and the fourth sockets are respectively engaged with the common contact plate and a single contact plate and the lead-in wires in the second and third sockets are all engaged with said common contact plates;

whereby, an electric current circulation is therefore established within sockets to lighten all the lamps.

5. The stepwise combined sockets as recited in claim 4, wherein the number of said sockets may be unlimited.

* * * * *